US012158141B1

(12) United States Patent
Pham

(10) Patent No.: US 12,158,141 B1
(45) Date of Patent: Dec. 3, 2024

(54) INVERTED FLUID CHAMBER

(71) Applicant: Welker, Inc., Sugar Land, TX (US)

(72) Inventor: Hung Ngoc Pham, Houston, TX (US)

(73) Assignee: Welker, Inc., Sugar Land, TX (US)

( * ) Notice: Subject to any disclaimer, the term of this patent is extended or adjusted under 35 U.S.C. 154(b) by 0 days.

(21) Appl. No.: 18/480,555

(22) Filed: Oct. 4, 2023

(51) Int. Cl.
*F04B 39/12* (2006.01)
*F04B 37/18* (2006.01)
*F04B 39/00* (2006.01)

(52) U.S. Cl.
CPC ..... *F04B 39/122* (2013.01); *F04B 37/18* (2013.01); *F04B 39/0005* (2013.01); *F04B 39/123* (2013.01)

(58) Field of Classification Search
CPC .... F04B 39/0005; F04B 37/18; F04B 39/122; F16J 3/02; F15B 15/10
See application file for complete search history.

(56) References Cited

U.S. PATENT DOCUMENTS

2003/0089867 A1* 5/2003 Hall ..... F15B 15/24 251/285
2004/0144429 A1* 7/2004 Lovell ..... F16K 37/0016 137/556.3
2008/0149877 A1* 6/2008 Bessman ..... F16J 3/02 251/331

* cited by examiner

*Primary Examiner* — Abiy Teka
(74) *Attorney, Agent, or Firm* — Husch Blackwell LLP

(57) ABSTRACT

A chamber for pumping relatively small volumes of fluid is provided. The chamber includes a plug moveable between a retracted position and an extended position. When the plug is in the retracted position, the plug may be positioned and located toward a first end of the chamber such that fluid may enter into the chamber through an inlet. Once the fluid is received into the chamber, the plug may be moved toward the extended position. As the plug moves toward the extended position, the plug may be pressed into a variable volume plate. As the plug is pressed into the variable volume plate, the plug may deform and enter into a cavity. When the plug enters the cavity, the plug may push fluid out from the cavity. Thus, a known volume of fluid may exit the chamber when the plug is moved from the retracted position to the extended position.

20 Claims, 5 Drawing Sheets

INVERTED FLUID CHAMBER

CROSS-REFERENCE TO RELATED APPLICATIONS

None.

FIELD OF THE INVENTION

The present invention relates generally to pumping small volumes of fluid. More particularly, the present invention relates to a chamber for ejecting a consistent volume of fluid from a pump.

BACKGROUND OF THE INVENTION

Natural gas is clear, odorless, and tasteless. Because of its potentially dangerous nature, federal regulations require the addition of an odorant to natural gas so that leaks can be detected by smell. Odorants such as tertiary butyl mercaptan (TBM), and various blends of commonly accepted chemicals, are used in the industry.

Odorants used with natural gas are relatively concentrated. Thus, only a small amount of liquid is needed to odorize a relatively large volume of natural gas. For example, with odorants such as TBM and other blends, it is common to use approximately 0.75 lb. of liquid odorant to odorize 1,000,000 standard cubic feet (SCF) of natural gas.

It is important that an accurately measured volume of odorant be added to natural gas. For example, odorants such as TBM are mildly corrosive. Thus, over-odorization can result in premature corrosion within the valves, pipes, and other equipment used for natural gas distribution. In addition, over-odorization causes the distinctive odorant smell to be noticeable even after the natural gas is burned. This leads to consumer calls complaining of natural gas leaks, each of which must be responded to by the natural gas distribution company. The expense of such calls is quite high when there is no leak involved.

It is also important that the odorant levels not be too low. Safety considerations mandate that a natural gas leak be easily detectable by most people. The proper concentration of odorant within natural gas provides this safety measure. However, leaks may not be detectable if the concentration of odorant is too low. Accordingly, it is necessary for natural gas distribution companies to avoid under-odorization or over-odorization when adding odorant to natural gas.

To address these issues, natural gas distribution companies may use a pump with a vanishing chamber to inject relatively small volumes of odorant into the natural gas.

FIG. 1 illustrates an example of a known pump 10 for pumping small volumes of fluid (e.g., odorant or natural gas) into a pipeline. Fluid may enter into a chamber 15 within the pump 10 via an inlet 20 positioned and located proximate to a first end 25 of the pump 10. When the pump 10 is operated, the pump 10 may push the fluid out from the chamber 15 via an outlet 30.

More particularly, when the pump 10 is operated, a shaft 35 moves between a retracted position and an extended position to push the fluid out from the chamber 15. In the extended position, the shaft 35 is positioned toward the first end 25 of the pump 10, and in the retracted position, the shaft 35 is positioned toward a second end 40 of the pump 10.

The shaft 35 may be moved between the retracted position and the extended position using a diaphragm mechanism 45 controlled by pneumatics. The diaphragm mechanism 45 is positioned and located proximate to the second end 40 of the pump 10.

As the shaft 35 moves between the retracted position and the extended position, the shaft 35 moves a cup member 50 within the chamber 15. For example, the shaft 35 may be in mechanical communication with bellows 55. The bellows 55 may expand and push a head member 65 downward as the shaft 35 moves toward the extended position. The head member 65 is coupled to a wear disc 70 that is positioned adjacent to the cup member 50. Thus, as the shaft 35 moves the head member 65, the shaft 35 may move the cup member 50.

Referring to FIG. 2, as the cup member 50 moves within the chamber 15, the cup member 50 may eject fluid out from the chamber 15. More particularly, when the shaft 35 (see FIG. 1) is in the retracted position, the cup member 50 may be positioned and located away from the inlet 20 and toward the second end 40 of the pump 10. As a result, fluid may enter the chamber 15 through the inlet 20 when the shaft 35 is in the retracted position which may thereafter be ejected in the manner set forth above.

As the shaft member 35 moves downward toward the extended position, the cup member 50 moves toward the outlet 30 in the chamber 15. As the cup member 50 moves toward the outlet 30, fluid within the chamber 15 may enter into a flexible portion 75. More particularly, the flexible portion 75 may be shaped as a concave void extending into the cup member 50. Furthermore, the cup member 50 may be sized such that the volume of fluid received within the flexible portion 75 is a known and predetermined volume.

As the cup member 50 continues to move toward the outlet 30, the cup member 50 may be placed into contact with seal members 80, 85 positioned and located proximate to the outlet 30. The seal members 80, 85 may form a fluid-tight connection with the cup member 50, and as a result, the volume of fluid may be sealed within the flexible portion 75.

As the shaft member 35 continues to move toward the extended position, the cup member 50 may be compressed between the wear disc 70 and the seal members 80, 85. In response to being compressed, the cup member 50 may deform such that the flexible portion 75 changes shape. In particular, the flexible portion 75 may bend outwardly such that the flexible portion 75 is no longer shaped as a concave void extending into the cup member 50. Instead, when cup member 50 is deformed by compression, the flexible portion 75 may transform into a flat surface. Thus, the concave void may shrink in size or vanish when the cup member 50 is compressed.

When the flexible portion 75 bends outwardly, the cup member 50 may eject fluid out from the flexible portion 75 toward the outlet 30. As the fluid is pushed toward the outlet 30, the fluid may be forced through a check valve 90 coupled to the outlet 30. Thus, the predetermined volume of fluid may exit the pump 10 when the cup member 50 is compressed by the shaft member 35.

These known vanishing chamber pumps 10 are not without deficiencies, however. For example, in known pumps 10, the cup member 50 is made of rubber. Over time, the rubber material may break down due to friction, repeated compression and expansion, and other forces experienced during operation. As the rubber material breaks down, the size and shape of the flexible portion 75 may change. When the flexible portion 75 changes size or shape, the volume of the void may change, and as a result, the volume of the fluid ejected from the pump 10 may begin to vary. Accordingly, known pumps 10 may become less accurate and less consistent over time.

In addition, the components of known vanishing chamber pumps 10 can be difficult to manufacture. For example, the flexible portion 75 of the cup member 50 should be manufactured in a precise manner so that the volume of odorant ejected from the pump 10 is within an acceptable range. However, it can be quite difficult to mold a precisely shaped cavity into a deformable rubber material. In addition, the cup member 50 must be chemically compatible with odorant, and there are very few suitable rubber materials that are compatible with odorant. Moreover, many of the compatible rubber materials can be quite difficult to procure and to mold. Therefore, it would be desirable to provide a pump that is configured to pump small volumes of fluid in an accurate and reliable manner. It would be further desirable for the components of the pump to be easy to procure or manufacture.

SUMMARY OF THE INVENTION

A chamber for pumping relatively small volumes of fluid (e.g., odorant) is provided. The chamber may be used with an odorant pump or various other types of pumps. Those skilled in the art will recognize that the chamber may be used with a variety of alternative fluids.

The chamber includes a plug that is moveable between a retracted position and an extended position. When the plug is in the retracted position, the plug may be positioned and located toward a first end of the chamber such that fluid may enter into the chamber through an inlet. As the fluid enters the chamber, the fluid is preferably received into a cavity in a variable volume plate.

Once the fluid is received into the cavity in the variable volume plate, the plug may be moved toward the extended position. As the plug moves toward the extended position, the plug may move toward the cavity in the variable volume plate, and the plug may be pressed into the variable volume plate.

As the plug is pressed into the variable volume plate, the plug may deform and enter into the cavity. When the plug enters into the cavity, the plug may fill the cavity and push the fluid out from the cavity. More particularly, the plug may push the fluid through a channel coupled to the outlet. As a result, fluid may exit the chamber when the plug is moved from the retracted position to the extended position. Furthermore, because the volume of the cavity is known, the volume of fluid ejected from the chamber may be known.

These aspects are merely illustrative of the innumerable aspects associated with the present invention and should not be deemed as limiting in any manner. These and other aspects, features, and advantages of the present invention will become apparent from the following detailed description when taken in conjunction with the referenced drawings.

BRIEF DESCRIPTION OF THE DRAWINGS

For a better understanding of the present invention, reference may be made to the following accompanying drawings.

DETAILED DESCRIPTION OF THE INVENTION

Figure 1:
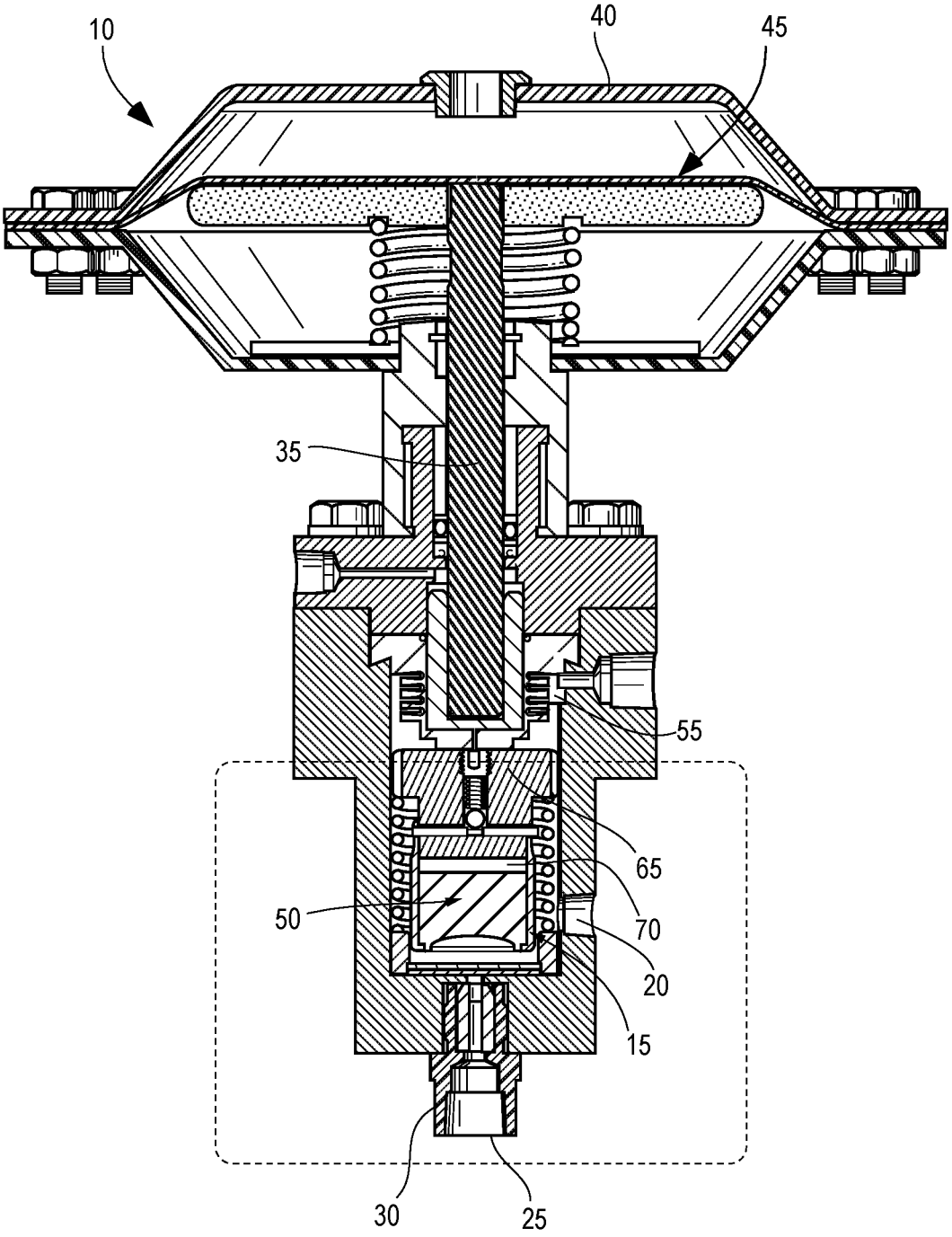
FIG. 1 PRIOR ART
FIG. 1 is a cross-sectional elevation view of a prior art pump.
Figure 2:
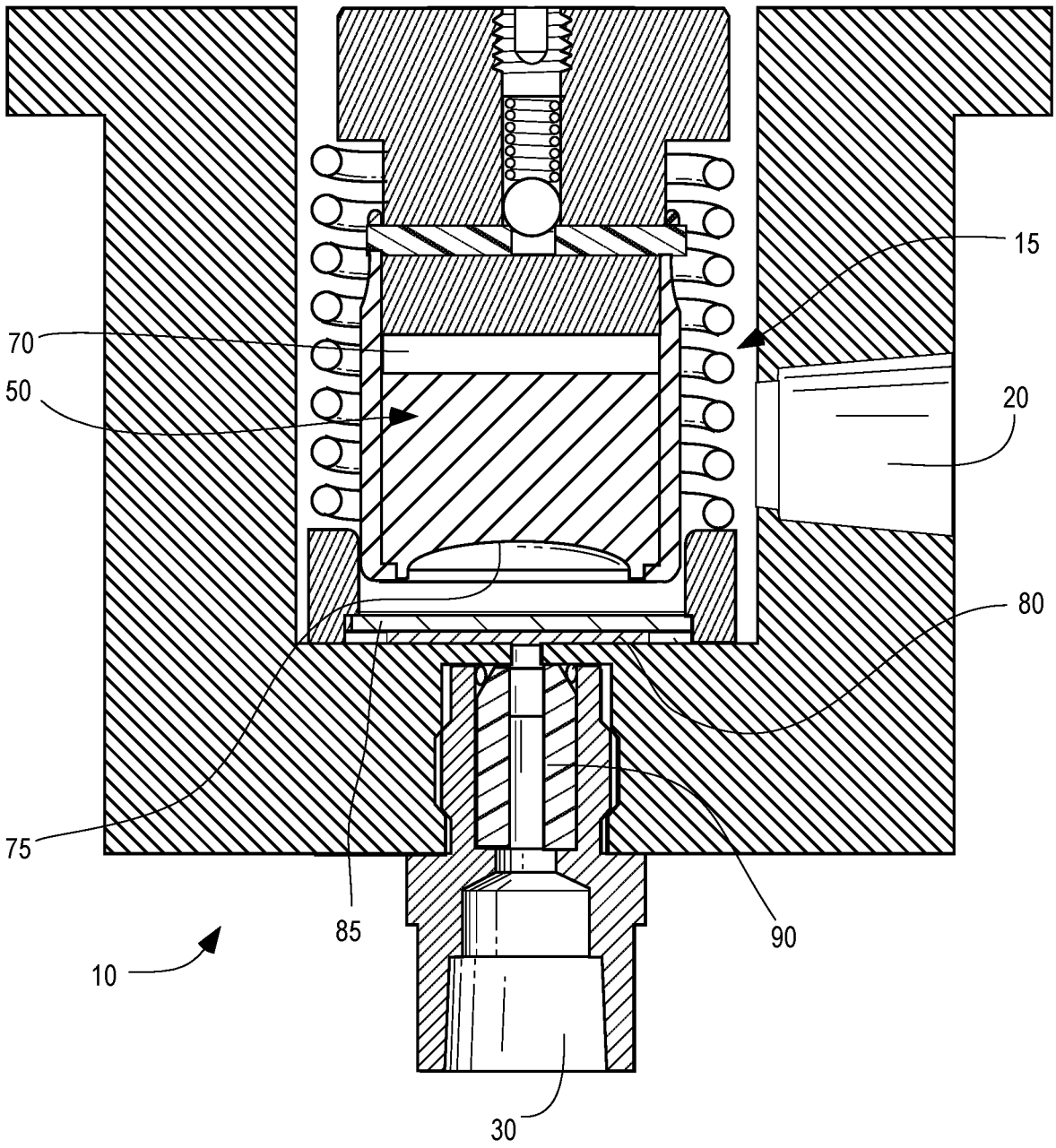
FIG. 2 PRIOR ART
FIG. 2 is an enlarged cross-sectional view of a vanishing chamber of the prior art pump of FIG. 1.
Figure 3:
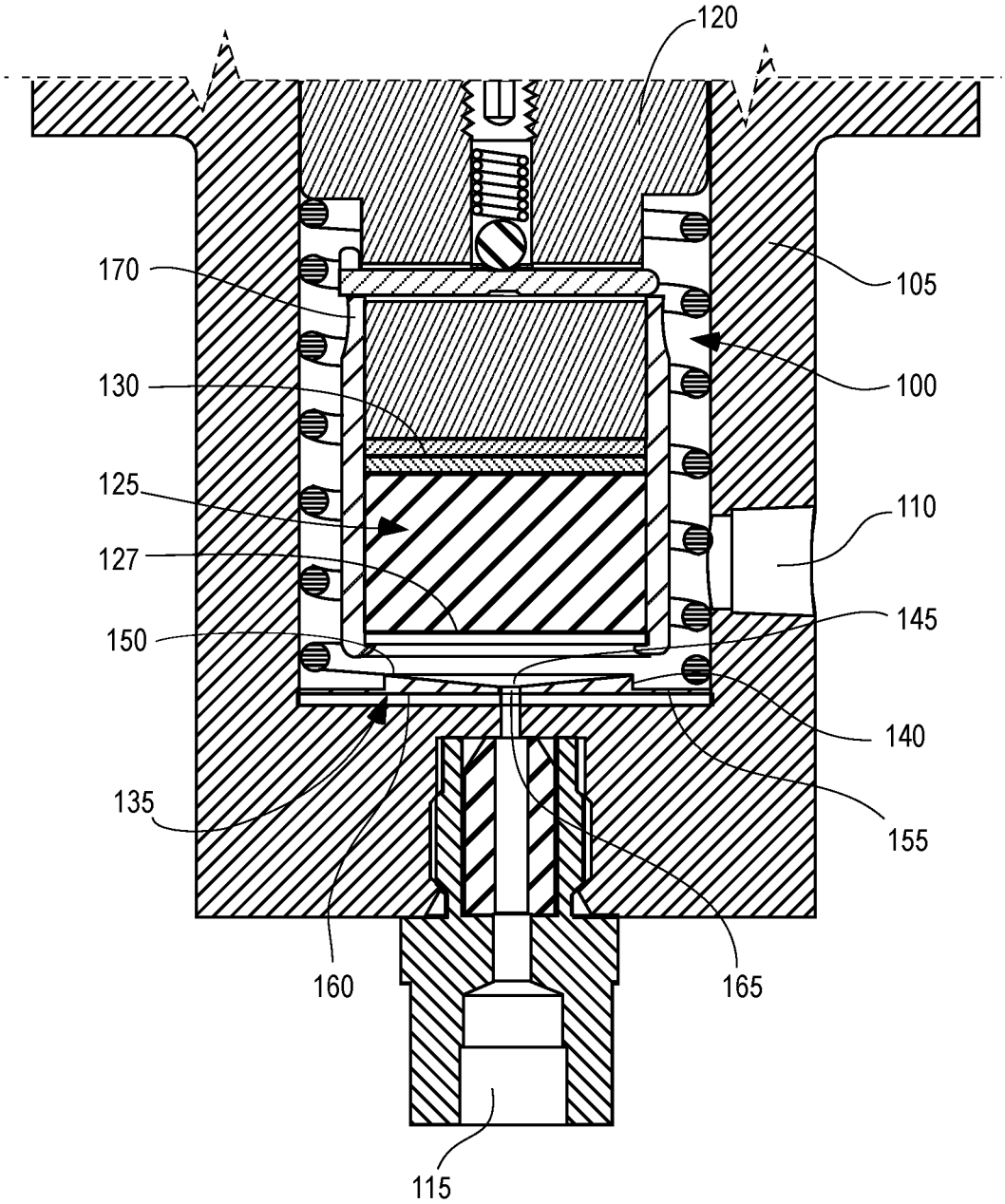
FIG. 3 is an enlarged cross-sectional view of a first embodiment of a vanishing chamber according to the teachings hereof.

FIG. 3 illustrates an embodiment of a fluid chamber 100 (hereinafter, "chamber 100") for pumping relatively small volumes of odorant or other fluids. The chamber 100 may be positioned and located within a lower body portion 105 of a pump (not illustrated). However, in alternative embodiments, the chamber 100 may be positioned and located elsewhere on the pump.

The lower body portion 105 may include an inlet 110 for receiving fluid into the chamber 100 and an outlet 115 for ejecting fluid out from the chamber 100. The inlet 110 may extend through the lower body portion 105 in a radial direction with respect to the chamber 100, and the outlet 115 may extend through the lower body portion 105 in an axial direction with respect to the chamber 100. However, in alternative embodiments, other configurations for the inlet 110 and the outlet 115 are foreseeable.

To pump fluid, a driven member 120 may be moved between a retracted position and an extended position (e.g., via a piston or shaft). When the driven member 120 is in the retracted position (as illustrated in FIG. 3), fluid may enter the chamber 100 via the inlet 110. For example, the plug 125 may be positioned and located away from the inlet 110 to allow fluid to enter the chamber 100.

Once fluid has entered the chamber 100, the driven member 120 may be moved toward the extended position. More particularly, the driven member 120 may be moved toward the outlet 115 of the chamber 100. As the driven member 120 moves toward the outlet 115, the driven member 120 may move a plug 125 within the chamber 100. The plug 125 may be shaped as a cylinder with a lower surface 127 that is substantially flat, and the plug 125 may be made of a rubber material. In addition, the plug 125 may be coupled to the driven member 120 via a disc 130. Accordingly, the lower surface 127 of the plug 125 may move toward the outlet 115 as the driven member 120 moves toward the extended position.

As the plug 125 moves toward the outlet 115, the plug 125 may be placed into contact with a variable volume plate 135 (hereinafter, "the plate 135"). When the plug 125 contacts the plate 135, the plug 125 and the plate 135 may form a fluid-tight connection to retain a predetermined volume of fluid. For example, the plate 135 may include a body portion 140 that is sized and shaped similarly to a cross-section of the plug 125. In addition, the plate 135 may include a cavity 145 that extends into the body portion 140. The cavity 145 may be cone-shaped, and a cross-section of the cavity 145 may extend across an upper end 150 of the body portion 140. In addition, the cavity 145 may be sized and shaped to have a known volume. As a result, the plug 125 may form a seal with the body portion 140, and a known volume fluid may be retained in the cavity 145.

A flange 155 configured to couple with the vanishing chamber 100 may be integrally formed with the body portion 140 of the plate 135. For example, the flange 155 may be shaped as a circular disc, and the flange 155 may positioned and located at a lower end 160 of the plate 135. The flange 155 may include one or more apertures (not illustrated) sized and shaped to receive a fastener (not illustrated). Thus, the plate 135 may be selectively coupled to the chamber 100 by extending a fastener through the flange 155. However, in other alternative embodiments, the plate 135 may be coupled to the chamber 100 using other suitable means (e.g., welds, rivets, adhesives, etc.).

As the driven member 120 continues to push the plug 125 downward, the plug 125 may enter into the cavity 145 to push the fluid out from the chamber 100. More particularly, the driven member 120 may press the plug 125 into the plate 135, and a portion of the plug 125 may deform to enter into the cavity 145. As the plug 125 enters into the cavity 145, the plug 125 may fill the cavity 145 and push the fluid out from the cavity 145. For example, the plug 125 may push the fluid through a channel 165 coupled with the outlet 115 of the chamber 100. Therefore, when the plug 125 is pressed into the cavity 145, the fluid retained in the cavity 145 may exit the chamber 100 through the outlet 115.

Referring still to FIG. 3, the chamber 100 may include a plug shield 170 for helping to maintain the shape of the plug 125. The plug shield 170 may be a hollow and cylindrical-shaped tube, and the plug 125 may be positioned and located within the plug shield 170. As a result, the plug shield 170 may circumscribe at least a portion of the plug 125 as the plug 125 is moved within the chamber 100. Moreover, the plug shield 170 may include a cross-section that is sized similarly to a cross-section of the plug 125. Thus, the plug shield 170 may help to prevent the cross-section of the plug 125 from expanding as the plug 125 is pressed into the plate 135.

Figure 4A:
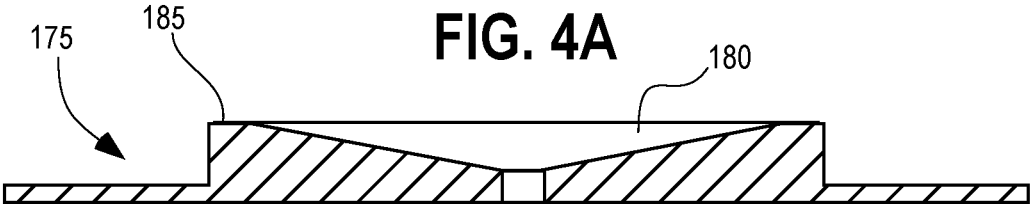
FIG. 4A is a cross-sectional elevation view of a first embodiment of a variable volume plate for the vanishing chamber of FIG. 3.

FIG. 4A illustrates an alternative embodiment of a variable volume plate 175. In contrast to the plate 135 (see FIG. 3), the variable volume plate 175 includes a cavity 180 that extends across only a portion of an upper end 185. Thus, the cavity 180 may be shaped more narrowly than the cavity 145.

Figure 4B:
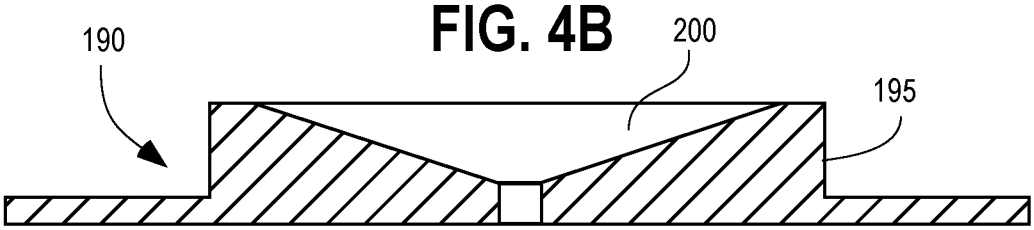
FIG. 4B is a cross-sectional elevation view of a second embodiment of a variable volume plate for the vanishing chamber of FIG. 3.

FIG. 4B illustrates another alternative embodiment of a variable volume plate 190. In contrast to the plate 135 (see FIG. 3), the variable volume plate 190 includes a body portion 195 that is taller than the body portion 140. As a result, the variable volume plate 190 may include a cavity 200 that is deeper than the cavities 145, 180. Thus, the cavity 200 may have a larger volume than the cavities 145, 180, and the variable volume plate 190 may be configured to pump larger volumes of fluid than the plates 135, 175.

Figure 4C:
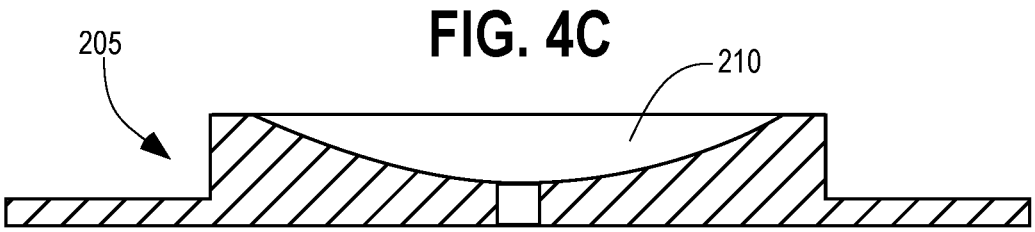
FIG. 4C is a cross-sectional elevation view of a third embodiment of a variable volume plate for the vanishing chamber of FIG. 3.

FIG. 4C illustrates another alternative embodiment of a variable volume plate 205. In contrast to the plates 135, 175, 190 (see FIGS. 3, 4A, and 4B), the variable volume plate 205 includes a cavity 210 with a rounded shape (e.g., a semi-sphere). The rounded shape of the cavity 210 may help to deform the plug 125 (see FIG. 3) as the plug 125 is pushed into the cavity 210 by the driven member 120. Accordingly, the variable volume plate 205 may be shaped to assist the plug 125 with filling the cavity 210.

Figure 5:
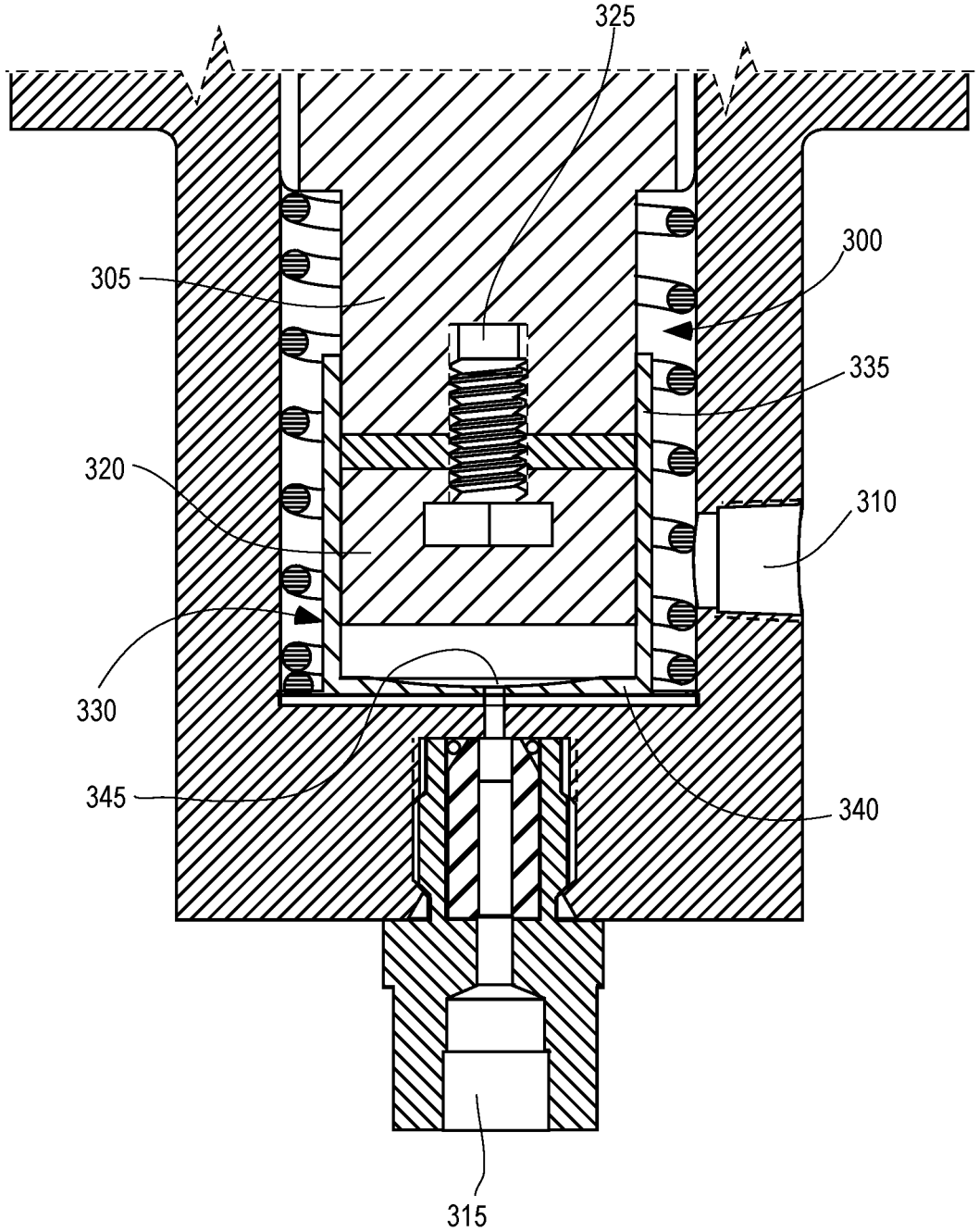
FIG. 5 is an enlarged cross-sectional view of a second embodiment of a vanishing chamber according to the teachings hereof.

Turning to FIG. 5, an alternative embodiment of a vanishing chamber 300 (hereinafter, "the chamber 300") is illustrated. Like the chamber 100 (see FIG. 3), the chamber 300 includes a driven member 305 that is moveable up and down to eject fluid from the chamber 300. For example, the chamber 300 may include an inlet 310 and an outlet 315, similarly to the chamber 100. Moreover, the chamber 300 may include a plug 320 which is moved by the driven member 305. In contrast to the plug 125 (see FIG. 3), the plug 320 may be coupled to the driven member 305 using a fastener 325. As a result, the plug 320 may be selectively decouplable from the driven member 305.

Similarly to the chamber 100, the chamber 300 may include a variable volume plate 330 (hereinafter, "the plate 330") for interfacing with the plug 320. However, in contrast to the plates 135, 175, 190, 205 (see FIGS. 3 and 4A-4C), the plate 330 may include a sidewall portion 335 protruding upwardly from a body portion 340. The sidewall portion 335 may be shaped as a hollow cylinder, and a cross-section of the sidewall portion 335 may be sized similarly to a cross-section of the plug 320. Accordingly, the sidewall portion 335 may partially surround the plug 320, and the plug 320 may be moveable within the sidewall portion 335. As a result, the sidewall portion 335 may help to guide the plug 320 toward the body portion 340 as the driven member 305 moves toward the extended position.

In addition, the sidewall portion 335 may help to maintain the shape of the plug 320 as the plug 320 is compressed by the driven member 305. In particular, the sidewall portion 335 may help to prevent the cross-section of the plug 320 from expanding as the plug 320 is pressed into the body portion 340. Thus, the sidewall portion 335 may help to ensure that the plug 320 is pushed into a cavity 345 as the plug 320 is pressed into the plate 330.

From the foregoing, it will be seen that the various embodiments of the present invention are well adapted to attain all the objectives and advantages hereinabove set forth together with still other advantages which are obvious, and which are inherent to the present structures. It will be understood that certain features and sub-combinations of the present embodiments are of utility and may be employed without reference to other features and sub-combinations. Since many possible embodiments of the present invention may be made without departing from the spirit and scope of the present invention, it is also to be understood that all disclosures herein set forth or illustrated in the accompanying drawings are to be interpreted as illustrative only and not limiting. The various constructions described above and illustrated in the drawings are presented by way of example only and are not intended to limit the concepts, principles, and scope of the present invention.

Many changes, modifications, variations, and other uses and applications of the present invention will, however, become apparent to those skilled in the art after considering the specification and the accompanying drawings. All such changes, modifications, variations, and other uses and applications which do not depart from the spirit and scope of the invention are deemed to be covered by the invention, which is limited only by the claims which follow.

The invention claimed is:

1. A chamber in a pump, the chamber comprising:

an inlet for receiving fluid into the chamber;

an outlet for pumping fluid out from the chamber;

a plug selectively moveable within the chamber;

a plate fixedly coupled to the chamber;

a cavity extending into the plate and in fluid communication with the outlet, the cavity configured to retain a volume of fluid; and wherein when the plug is moved toward the plate, the volume of fluid retained in the cavity exits the chamber through the outlet.

2. The chamber of claim 1, wherein the plug includes a lower surface that is flat.

3. The chamber of claim 1, wherein when the plug is moved away from the plate, the chamber is configured to receive fluid via the inlet.

4. The chamber of claim 1, further including a sidewall protruding away from the plate to surround at least a portion of the plug.

5. The chamber of claim 1, wherein the cavity has a rounded shape.

6. The chamber of claim 1, further including a check valve coupled to the outlet.

7. The chamber of claim 1, wherein the plug is selectively decouplable from the chamber.

8. A chamber for a pump, the chamber comprising:
a plate coupled to the chamber;
a cavity extending into the plate;
an outlet in fluid communication with the cavity;
a plug having a lower surface that is flat, the plug selectively moveable within the chamber between a first position and a second position; and
wherein when the plug is moved from the first position to the second position, a volume of fluid retained in the cavity is ejected through the outlet.

9. The chamber of claim 8, wherein the lower surface of the plug is positioned and located adjacent to the plate when the plug is in the second position.

10. The chamber of claim 8, wherein the lower surface of the plug is positioned and located apart from the plate when the plug is in the first position.

11. The chamber of claim 8, further including a sidewall protruding from the plate, wherein the sidewall is sized and shaped to partially surround the plug as the plug is moved between the first position and the second position.

12. The chamber of claim 8, wherein the plug is selectively couplable to a shaft using a fastener.

13. The chamber of claim 8, wherein the cavity is cone-shaped.

14. The chamber of claim 8, wherein the cavity is semi-spherical shaped.

15. A chamber for a pump, the chamber comprising:
a plate coupled to the chamber;
a plug having a lower surface that is flat, the plug selectively moveable within the chamber between a first position and a second position;
wherein when the plug is in the first position, the plug is positioned and located apart from the plate;
wherein when the plug is in the second position, the lower surface of the plug is positioned and located adjacent to the plate; and
wherein when the plug is moved from the first position to the second position, the plug is configured to eject fluid out from the chamber.

16. The chamber of claim 15, wherein the plug is cylindrical-shaped.

17. The chamber of claim 15, further including a plug shield coupled to the plug, wherein the plug shield partially surrounds at least a portion of the plug to maintain the size and shape of the plug.

18. The chamber of claim 15, wherein when the plug is in the first position, the plug is positioned and located to facilitate fluid entering the chamber.

19. The chamber of claim 15, wherein the plate further includes a cavity that is cone-shaped.

20. The chamber of claim 15, wherein the plug is made of a rubber material, and wherein the chamber is configured to pump fluid for a natural gas system.

* * * * *